US005937558A

United States Patent [19]

Gerard

[11] Patent Number: 5,937,558

[45] Date of Patent: Aug. 17, 1999

[54] ELECTRONICALLY DISCHARGED AND GAS OPERATED FIREARM

[76] Inventor: Donald G. Gerard, 2720 Birch Tree Dr., St. Charles, Mo. 63301

[21] Appl. No.: 09/103,245

[22] Filed: Jun. 23, 1998

Related U.S. Application Data

[62] Division of application No. 08/892,917, Jul. 15, 1997, Pat. No. 5,784,821.

[51] Int. Cl.[6] ..... F41A 19/00

[52] U.S. Cl. ..... 42/84; 42/39.5; 42/15

[58] Field of Search ..... 42/84, 39.5, 15; 89/155, 156

[56] References Cited

U.S. PATENT DOCUMENTS

| | | | |
|---|---|---|---|
| 597,588 | 1/1898 | Nygren | 42/7 |
| 1,267,293 | 5/1918 | Veteto | 102/380 |
| 1,468,822 | 9/1923 | Ludorf | 42/84 |
| 2,790,353 | 4/1957 | Bird | 89/1.7 |
| 3,495,349 | 2/1970 | Thompson | 42/84 |
| 3,651,593 | 3/1972 | Clark | 42/65 |
| 4,019,273 | 4/1977 | Kibler et al. | 42/1 |
| 4,109,557 | 8/1978 | Zavcha | 89/7 |
| 4,159,670 | 7/1979 | Turner | 89/155 |
| 5,044,278 | 9/1991 | Campbell | 102/202.8 |
| 5,485,786 | 1/1996 | Hesse et al. | 102/202.5 |

*Primary Examiner*—Charles T. Jordan
*Assistant Examiner*—Meena Chelliah
*Attorney, Agent, or Firm*—Richard J. Grundstrom

[57] ABSTRACT

An electrically discharged and gas operated firearm basically has of a main body with a gun barrel being attached to a front surface. A chute is defined vertically through the main body. A cartridge holding cassette slides into the chute. The cassette functions as both a clip and a firing chamber. A gas operated piston operates a slide that is used in moving and positioning the cassette in the chute as the firearm is being fired. A gas port from barrel to the piston port provides a path for the gases. A pulldown link operated by the slide engages the cassette to position the cassette as the piston operates. An indexer link engages the cassette to hold the cassette in a specific position for firing. A wedge shaped clutch within the main body maintains contact between the front face of the cassette and the back face of the front plate on the main body. An electrical trigger is attached to the front of the main body. An electrical firing pin mounted on the back plate of the main body directs an electrical pulse to an electric primer on the ammunition to fire the cartridge. The electrical controls contained within various parts of the firearm generates the electrical pulse as the trigger is pulled. The electrical controls can be set for full automatic, semiautomatic, burst in specific number of shots per each trigger pull and can incorporate electrical security controls to prevent unauthorized firing. This invention eliminates moment and rotation by directing inertia inline with the center of gravity and with the shooter arm and eliminates most kick caused by discharge and bolt action.

23 Claims, 15 Drawing Sheets

ELECTRONICALLY DISCHARGED AND GAS OPERATED FIREARM

This is a division of application Ser. No. 08/892,917 filed Jul. 15, 1997, titled Electrically Discharged and Gas Operated Firearm, issuing as a U.S. Pat. No. 5,784,821 on Jul. 28, 1998.

This invention relates to an electrically discharged and gas operated firearm and more particularly to a firearm that has a center located barrel, electrically discharged cartridges and gas operated action.

Conventional or typical firearms, particularly handguns, "flip" when discharged. Where "flip" means gun rotation about the center of gravity of the gun that further translates to the shooter's wrist and/or elbow, causing them to pivot. This is due to a moment created by the discharging force along the centerline of the barrel acting at a distance from the center of gravity of the gun. This further creates another moment between the center of gravity of the gun and the axis of the wrist and/or elbow. In another words this is the action that causes the "kick" or the upward pivoting of the firearm held in the hand as it is fired.

One objective of this invention is to remedy this situation and to reduce or eliminate the "flip." In accordance with this objective, the firearm of this invention has the barrel and the center of mass centerline passing through the center of gravity of the gun. The gun is held, in the preferred embodiment, so that the barrel passes between the middle and third fingers This positions the centerline of the barrel directly in line with the wrist axis. The resulting moment arms are reduced to zero which eliminates flip. With the barrel mounted in this fashion the gun will recoil rearward since the recoil force is directed in a straight line through the center of gravity of the gun and the shooter's wrist.

Another objective of this invention is to provide a hand gun that utilizes an electrically discharged cartridge. Typical ammunition is discharged with a percussion device, where an impact causes a spark to ignite the powder in the cartridge. This is a purely mechanical mechanism. Whereas, the electrically discharged action of this invention is purely electrical. With this improvement, the discharge is under better control. The electronics causing the electrical discharge can be controlled and safety mechanisms can be implemented. The electrically discharged capability of this invention controls the firing sequence of the firearm. The electrical controls can be manufactured to allow either full automatic or semiautomatic operation, timing between shoots can be controlled, time from trigger pull to detonation can be controlled. All of this and more is available to the electrically fired gas operated firearm of this invention.

The typical firearm also has a rearward "kick" caused by the rearward motion, sudden stopping and reverse direction of the bolt or slide. The bolt is driven rearward by the gases shortly after the firearm is fired. This action pulls the spent cartridge from the chamber and ejects the empty shell. Once the bolt reaches the end of travel, the bolt suddenly stops. A spring then provides forward bias to drive the bolt forward and pushes a new cartridge in the chamber.

In accordance with the objective of this invention, the "kick" cause by a horizontally sliding bolt is completely eliminated. There is no moving bolt for the removal and replacement of a cartridge in the chamber with the electrically discharged and gas operated firearm of this invention. Rather, a firing chamber is contained in a cassette that also functions as the clip or magazine. Rather than having a moving bolt, the cassette moves to position the cartridge to completely eliminate "bolt kick."

The action of this invention does impart some vertical motion when fired due to the repositioning of the cassette. This motion is very small because the mass of the components moved by the discharge gas is small and the cassette travels a relatively short vertical distance powered by an operating spring.

It is typical in the field of munitions to use the discharge gases for the removal of spent cartridges from the breech of the gun and to provide the necessary forces to cause a new cartridge to be loaded. This is often done with a slide bolt in a semiautomatic or full automatic weapon. The discharge gases cause a rearward force on the bolt to discharge the spent cartridge. A new or fresh cartridge from a magazine is pushed upward into the path of the bolt. The forward motion of the bolt caused by a spring, forces the new cartridge forward into the chamber. As indicated above this causes a rearward "kick" which is eliminated by the action of this invention.

Yet another objective of this invention is to utilize the discharge gases to move the cartridges, rather than a bolt. This action provides a more simple arrangement and fewer components. In accordance with this invention, a cassette containing cartridges and the firing chamber is repositioned by the discharges gases. This eliminates the complicated action of removing a spent cartridge and placement of a fresh cartridge by the sliding of a bolt.

Another objective of this invention is to prevent jamming and possible misfire that is typical in the firearms now known in the art. The cartridges in the standard or typical firearm are being forced into chamber by the sliding bolt. This is a mechanical action in which the bolt slides rearward and a spring forces a new cartridge upward in front of the bolt. Then the bolt forces the cartridges, one at a time, into the chamber and locks them in a firing position. However, often a cartridge is not properly positioned due to the many different forces acting on the cartridge. This results in misalignment and jamming of the action. The action of this invention eliminates this problem.

In accordance with this objective the action on a single cartridge is reduced to eliminate essentially all jamming and all misfiring. In this invention the cassette containing the cartridges is being moved rather than an individual cartridge. The action of removing and replacing a cartridge is drastically changed. It has been demonstrated that all jamming associated with the sliding bolt and clip design of the common firearms has been completely eliminated as well as the possible misfiring.

A fear of law enforcement individuals is that their firearm will be taken from them and they will be shot with their own weapon. A number of different security mechanisms have been developed to prevent this from happening. One of the most successful is a ring worn by the officer. The ring must properly engage the firearm for the trigger to be pulled. However, this system also has drawbacks. The ring has to be exactly positioned. This could be a problem for rapid developing situations or during some abnormal shooting positions.

Yet another objective of the electrically discharged gas operated firearm of this invention is to provide security measures to prevent unauthorized firing. These security methods can be implemented for the protection of law enforcement individuals as well as for protection of unauthorized use in the home, such as by children. In addition, a simple "chain type bicycle lock" could be used very effectively because the cassette must be removed to install the lock leaving the firearm without a firing chamber.

Military operations often need a firearms with capabilities for full automatic and semiautomatic operation.

Typically, firearms are one or the other, but not both. There are a few exceptions, but not many. Typically, firearms that are full automatic have the moment and kick associated with the operation. As the firearm is fired it rotates upward and off the target. Therefore, most of the fully automatic weapons of the past have been larger firearms often with handles or supports to help in controlling the moment and rotation.

Another objective of this invention is to provide an electrically discharged and gas operated firearm that has full automatic capabilities and semi-automatic capabilities in a single firearm, yet maintain control by the elimination of the moment and rotation caused by other firearms known in the art.

It has been demonstrated that the moment and rotation as well as the "kick" associated with a typical firearm has been essentially eliminated by the electrically discharged and gas operated firearm of this invention. Firing the electrically discharged and gas operated firearm in the full automatic mode results in no upward rotation. Therefore, maintenance of target position throughout continued shooting remained constant.

The typical firearm, during reloading, has to have a new clip or magazine installed, or a group of cartridges placed in the magazine. During reloading the firearm can not be used. For some firearms, this may take time.

Another objective of this invention is to provide the shooter a positive indication of the remaining cartridges within the firearm without the need to remember or count.

One more objective of the electrically discharged and gas operated firearm of this invention is to eliminate the need to stop firing during reloading. This saves time when continued firing is wanted or needed. In accordance with this invention, one cassette is feed one after another with no stopping to reload. It is possible to continue shooting non-stop as long as there are cassettes available. The time needed to reload has been eliminated.

An additional objective of this invention is to provide the shooter with ammunition that would work in either an electrically discharged and gas operated firearm of this invention or with a standard firearm requiring standard percussion type action.

SUMMARY

To accomplish the foregoing and other objects of this invention there is provided the electrically discharged and gas operated firearm of this invention. In general terms the electrically discharged and gas operated firearm can be described as having the following components.

A main body made up of a front plate, back plate, left side plate and right side plate. The plates, in addition to making up the main body, define a chute through the center of the main body. A gun barrel is attached to the front surface of the main body or front plate, The barrel is in alignment with a bore leading to the chute. A cassette having a plurality of lateral bores therethrough, slides into and interacts with mechanism within the chute. Each of the lateral bores within the cassette receives a cartridge and functions as the firing chamber for the cartridge.

A piston is installed within a piston port in the main body. The piston is operated by gasses feed from the breech of the barrel. A gas port extending from the breech to the piston port provides a path for the gasses. This provides the gas operated feature of the electrically discharge and gas operated firearm of this invention. A slide is connected to and is operated by the piston. The slide is contained within an opening on the main body and it travels in conjunction with the piston.

A pulldown link is pivotally attached to the slide and positioned within an indentation on an inside surface of the chute. The pulldown link has a pawl to engage the cassette within the chute. As the slide operates the pulldown link ,the pulldown link operates to reposition the cassette in the chute. An indexer link is pivotally attached within the same indentation within the chute as the pulldown link. The indexer link is pivotally operated by the pulldown link. The indexer link has an index link pin that engages or disengages an index cavity on the cassette as the indexer link is pivoted. The indexer link holds the cassette in a specific position when the index link pin is engaged with an index cavity on the cassette. The position is such that a bore containing a cartridge on the cassette is in alignment with the bore aligned with the barrel.

An electric trigger is attached to an outside surface of the main body. An electrical firing pin is attached to and extending through an opening on the back plate of the main body. The electrical firing pin is in alignment with the bore containing a cartridge in the cassette and in alignment with the barrel attached to the front plate of the main body. An electric circuit electrically attaches the electric firing pin to the electric trigger and provides a controlled electrical pulse to the electric firing pin when the electric trigger is pulled. The electric circuitry can be programmed to fire the firearm in a semiautomatic, full automatic mode or in bursts. The number of shots per trigger pull and the timing between shoots can all be controlled electrically. In addition, security measures can be electrically implemented through the electronic circuit to prevent unauthorized use.

These and the above and other objects and features of the present invention will be better understood and appreciated from the following detailed description of the main embodiments thereof, selected for purposes of illustration and shown in the accompanying drawings.

DETAILED DESCRIPTION

Figure 2:
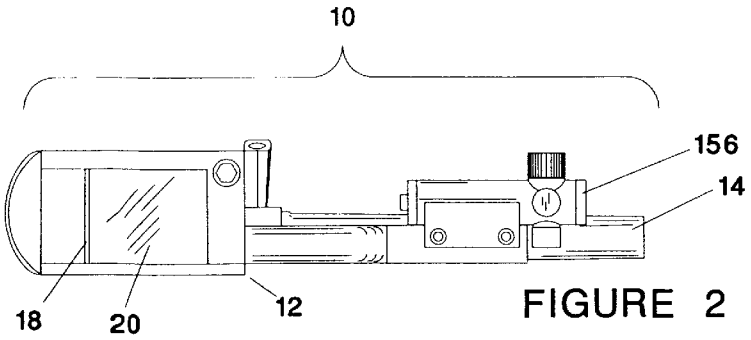
FIG. 2 is a top view of FIG. 1.
Figure 3:
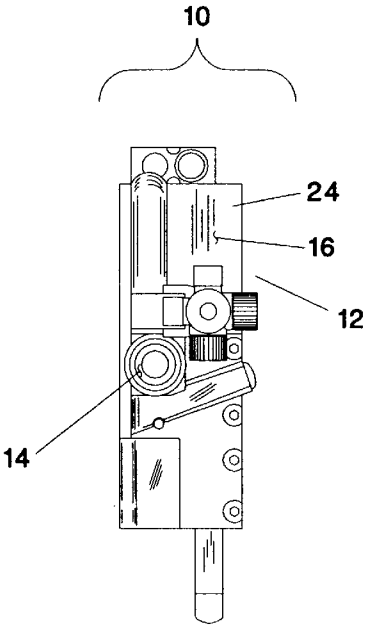
FIG. 3 is a front view of FIG. 1.

Referring now to the drawings in general there is shown three embodiments of the electrically discharged gas operated firearm of this invention. These embodiments were selected in that they represent various methods of implementation of the inventive concepts disclosed herein.

There are various embodiments of the electrically discharged and gas operated firearm of this invention. All embodiments contain certain common and basic components, but the exact combination and configuration of the components may differ. Because of the differences in sizes, calibers, configurations and the many embodiments possible, there may be additional components, deletion of some and modification of others, depending on the specific requirements of the embodiment. The basic components will be described generally with specifics of individual embodiments.

Three embodiments selected to represent the principles and variations of this invention and the best mode contemplated of the electrically discharged and gas operated firearm of the present invention are herein described. However, it should be understood that the best mode for carrying out the invention hereinafter described is offered by way of illustration and not by the way of limitation. It is intended that the scope of the invention include all modifications which incorporate its principal design features. It should be understood that the firearm described herein is a technology development fixture and is not meant to define the exact configuration of a production model.

The principle component common to all embodiments of the electrically discharged and gas operated firearm 10 of this invention begins with a main body 12. The main body 12 supports a barrel 14 vertically located in a generally center position on the front surface 16 of the main body 12. The principle embodiments illustrated all show the barrel 14 being centrally located. However, the barrel 14 could be located at any other location without departing from the scope and spirit of the inventive concepts herein disclosed. Another configuration would be to locate the barrel 14 near the top of the main body 12 in a more conventional manner. In order to accommodate the difference in location there would be obvious adjustments to the mechanics and configuration as herein disclosed.

The main body 12 contains a chute 18 that receives a movable cassette/firing chamber combination, referred to as the cassette 20. All cassette 20 positioning mechanisms, all gas operated cassette advancement mechanical pieces, one-way-clutch, cassette biasers, cassette delatcher assembly, an electrical firing pin, an electrical trigger, all springs and various pivots and parts are all attached to or are contained on or within the main body 12 in one manner or another.

Figure 20:
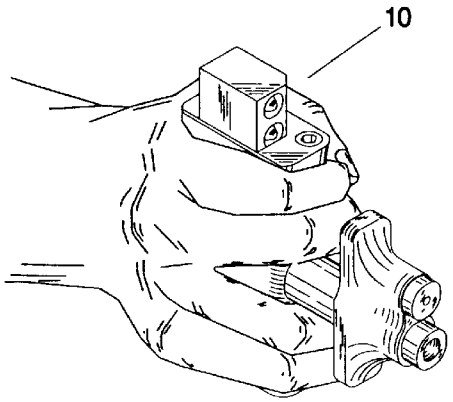
FIG. 20 illustrates the typical handhold for the electrically discharged and gas operated firearm shown in FIG. 17.
Figure 21A:
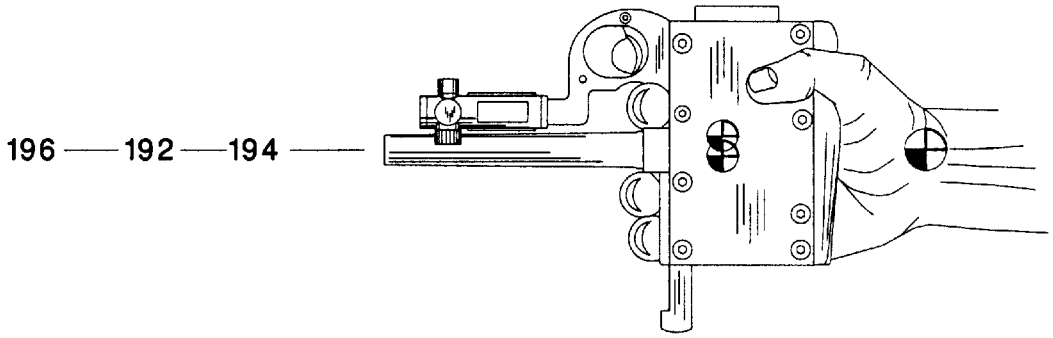
FIGS. 21A–21C shows the relationship and differences in the center of gravity, the pivotal moment and the recoil between the electrically discharged and gas operated firearm of this invention, a standard revolver and a standard semi-automatic handgun. Center of gravity and moment are indicated by a circles with four way partially shaded partitions.

The main body 12 of this firearm has a pass-through chute 18 through which the cassette 20, containing cartridges 32, passes. The shooters hand wraps around the body as shown in FIGS. 21A and 20. The main body essentially forms the handle for the firearm. Handle grips can be added to the main body for comfort and to form housings for electronics. Since the cassette 20 passes through the gun's main body 12, the total length of the gun can be minimized if desired. Shorting the barrel 14 further reduces flip and lateral rotational effects. This may occur due to residual moment arm effects if the barrel 14 axis is not exactly straight through the center of gravity of the gun and the wrist pivot. It is expected that the center of gravity of the gun will vary vertically as the cassette passes through the chute.

The main body 12 can be in several different configurations. All will have a barrel receiving means 34 on the front surface 16, to which a barrel 14 will be attached. There will also be indentations, gas ports, piston port, both threaded and non-threaded bores contained within or on the main body 12 for all the various components and functions. These will be described throughout the text.

In one main embodiment, FIGS. 1–6, the main body 12 consists of three components. The main body 12 has a principle body portion that has a general L-Shape configuration making up the front and left side. For descriptive purposed these will be referred to as the front plate 24 and left side plate 26. The front surface 16 of the front plate 24 contains a barrel receiving means 34. A piston port, gas ports, and indentations for the pull down link and indexer are all contained on the front plate 24.

A back plate 28 fits on the rear edge of the left side plate 26. The back plate 28 has a receiving area for a one way clutch 22 block, and an opening 40 therethrough for an electronic firing pin 96. The clutch block 22 may also have an opening therethrough, corresponding to opening 40, for the electrical firing pin 96.

A right side plate 30 covers the right side of the main body 12 by attaching to the front plate 24 and back plate 28. Typically The plates 24, 26, 28 and 30 will be attached by screws 42 but other methods could be used. The combination of the plates 24, 26, 28 and 30 in this manner creates the chute 18 through and defines the main body 12.

The chute 18 will have an entrance and an exit. The embodiments shown have the entrance on the top and the exit on the bottom. However, the electrically discharged and gas operated firearm 10 of this invention could also be constructed with the entrance on the bottom or even on a side if desired. To receive the maximum benefits the chute 18 should be vertical.

In another embodiment, FIGS. 9–15, the main body 12 consists of a Shallow U-shaped channel 44 and a cover plate 46. Indentations, grooves, openings and bores are contained on and within the U-shaped channel 44. The U-shaped channel will further be defined as being made of a front plate 24, left side plate 26, and back plate 28. The gun barrel 14 is attached to the barrel receiving means 34 on the front surface 16 of the front plate 24. Generally, the barrel receiving means 34 will be a threaded section onto which the barrel 14 can be screwed. The barrel 14 is generally a standard or typical barrel 14 with no special modification. The caliber of the barrel 14 used on the electrically discharged and gas operated firearm 10 partially determines the overall dimensions of the firearm and exact size of the components. Other considerations on the size and configuration would be the desires of the user, number of shots in the cassette 20, and hand size, just to name a few. Other considerations might also come into play.

A cassette 20 is generally rectangular with a plurality of bores 48 therethrough, sized to fit within the chute 18. The bores 48 through the cassette 20 receive and hold cartridges 32 to be fired. The cassette 20 also functions as the firing chamber for the cartridges. The cassette 20 slides into and through the chute 18. The cassette 20 can be all metal or can be made with a plastic material with steel inserts. The later will have the benefits of being lighter in weight.

Figure 6:
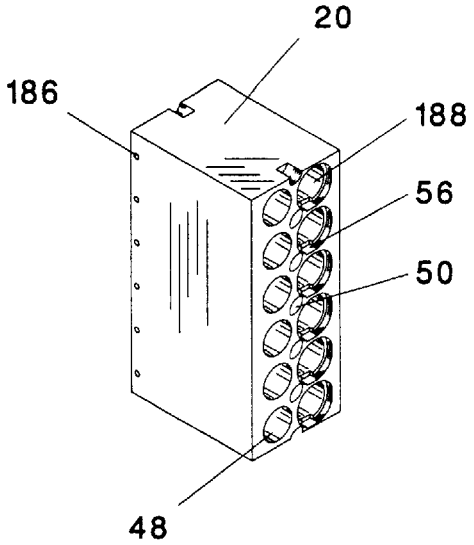
FIG. 6 is an isometric view of the cassette showing the opposite sides of the same cassette shown in FIG. 4.
Figure 7D:
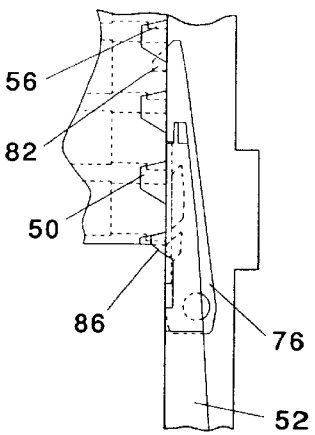
FIGS. 7A–7G is a sequence of drawings showing the action of the pulldown link and indexer link used in repositioning the cassette in the chute within the main body.
Figure 7C:
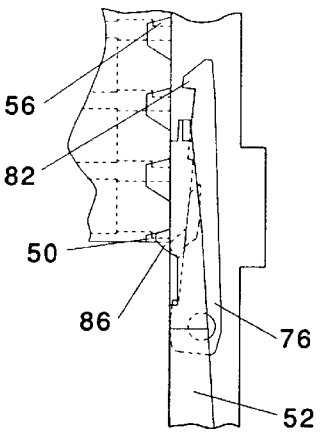
Figure 7B:
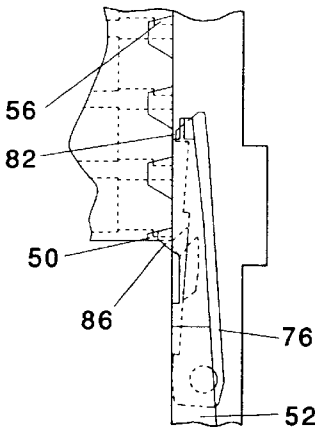
Figure 7G:
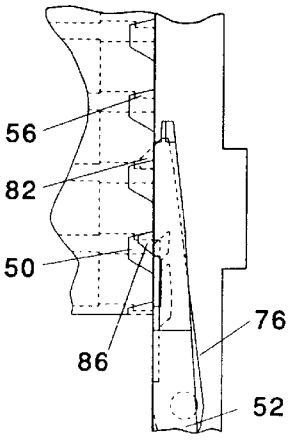
Figure 7F:
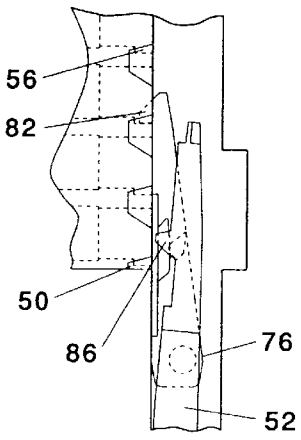
Figure 7E:
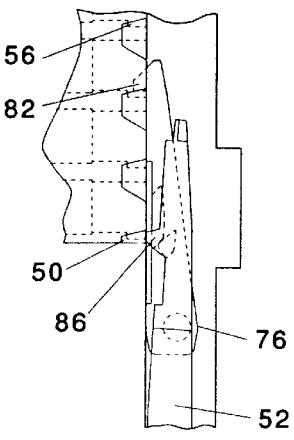
Figure 7A:
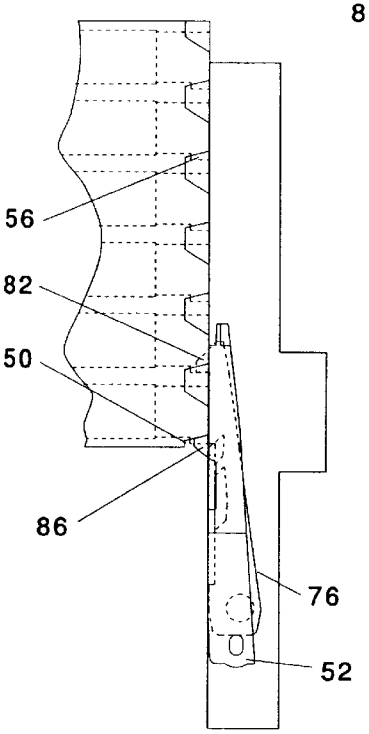
Figure 8A:
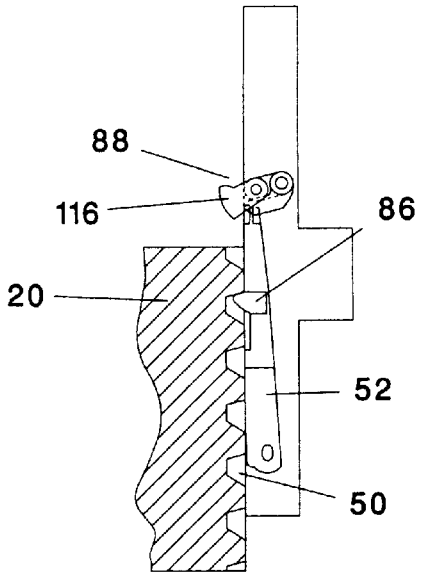
FIGS. 8A–8D is a sequence of drawings showing the action of the indexer link and delatcher.
Figure 8B:
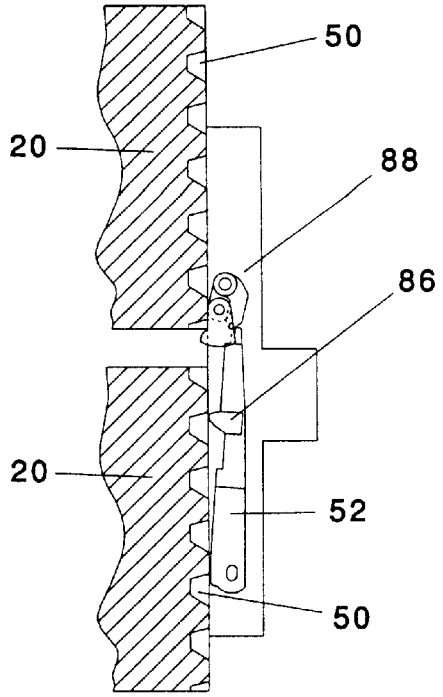
Figure 8C:
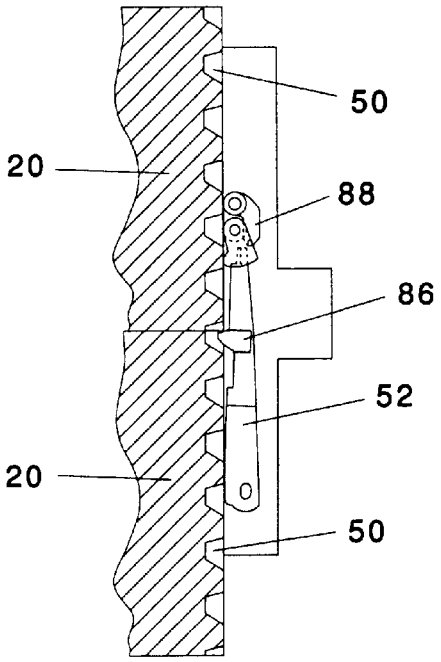
Figure 8D:
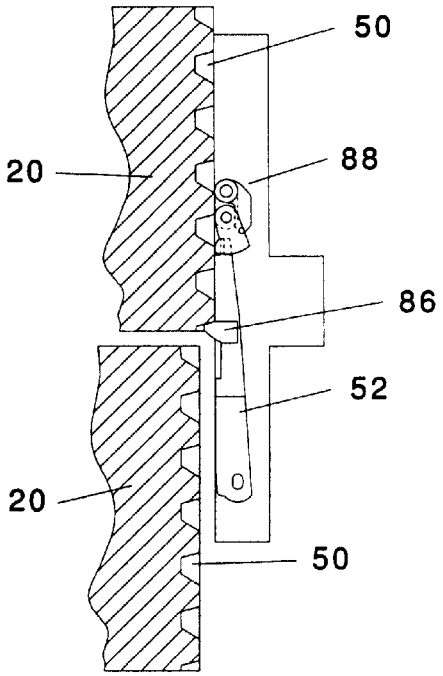
Figure 9:
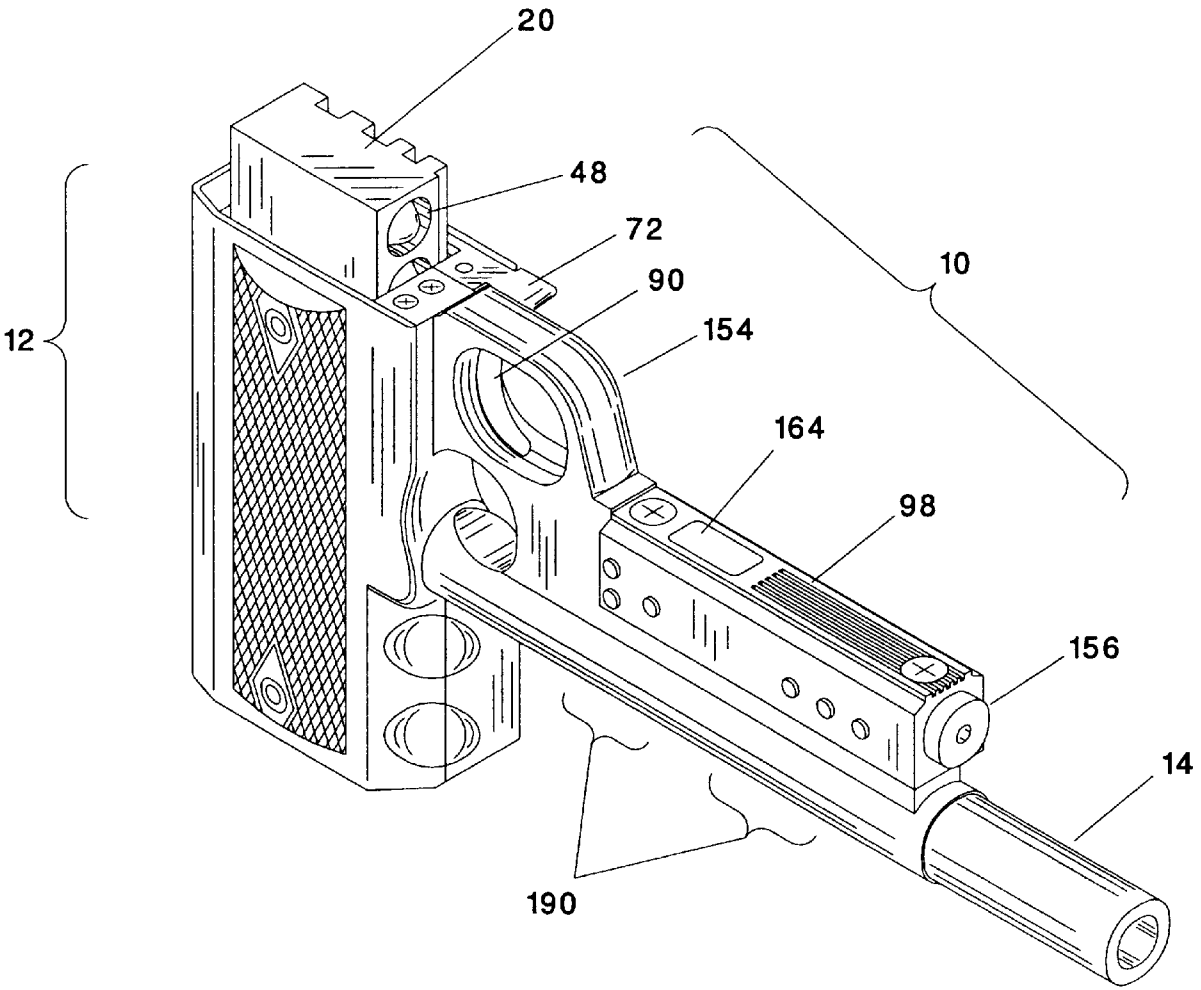
FIG. 9 is an isometric view of another embodiment of the electrically discharged and gas operated firearm of this invention.
Figure 11:
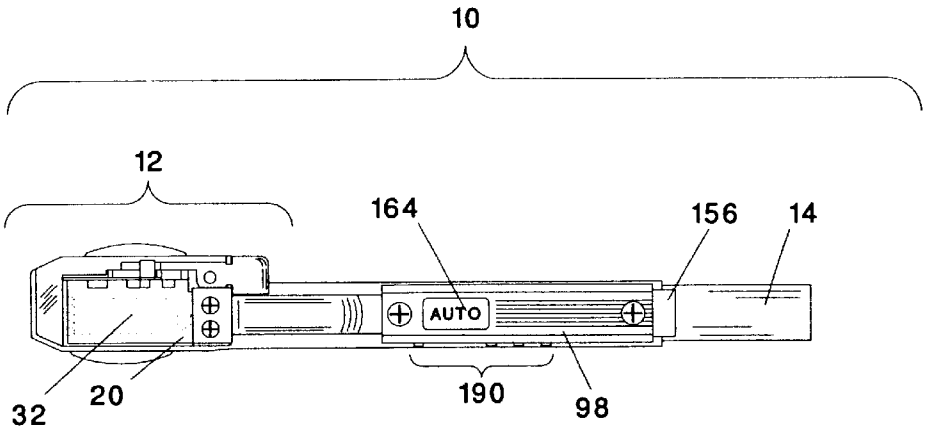
FIG. 11 is a top view of FIG. 9.

Cartridge retention stubs 186 (one for each cartridge) are provided to retain the cartridges 32 in the cassette 20. Referring to FIG. 6, the cartridge retaining stubs 186 are made of a plastic rod type material that fit within small bores. The small bore are located in the cassette 20 such that the cartridge retaining stubs 186, when inserted in the small bores, bear on the casing of the cartridges 32 when in the cassette 20. The cartridge retaining stubs 186 create a fiction hold on the cartridges 32 to prevent the cartridges 32 from falling out.

Figure 14:
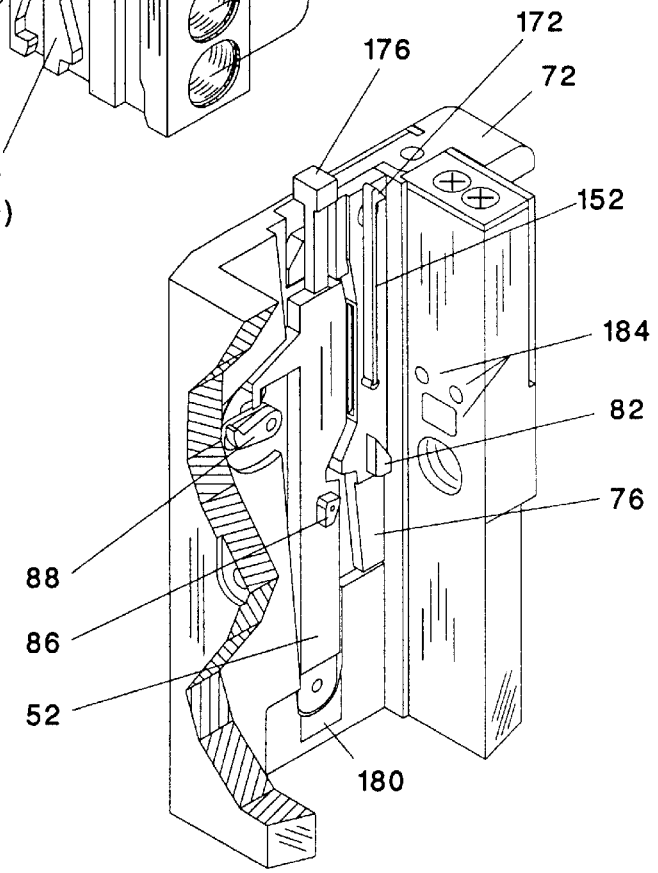
FIG. 14 is a partial sectional view of the main body of the electrically discharged and gas operated firearm of FIG. 9 showing the placement of the pulldown link, indexer link, delatcher in the main body and the cartridge remaining indicators.

Positive cartridges remaining indication is provided as shown in FIG. 14. As the electrically discharged and gas operated firearm 10 is fired and the cassette 20 advances through the chute 18, visual cartridge remaining spots 184 are uncovered. As illustrated, when the next to the last cartridge is aligned with the barrel 14, the shooter could look in chute 18 and see the uncovered two small cartridge remaining spots 184. This would tell the shooter that he has two unfired cartridges 32 available. When the next to the last cartridge 32 is fired, one large cartridge remaining spot 184 is displayed within the chute 18. This tells the shooter that he has one remaining unfired cartridge 32.

The cassette 20 will have a plurality of indexer cavities 50, one for each cartridge, used in conjunction with the indexer link 52 to hold the cassette 20 in a given position. Each index cavity 50 in the embodiment shown in FIGS. 4, 6, 7 and 8 is a simple slotted bore near the opening of each of the bores 48 on the front surface of the cassette 20. In the embodiment shown in FIGS. 9–15, the index cavity 50 is a rack gear configuration 54 along the side of the cassette 20. The rack gear configuration 54 can be machined into the cassette 20 or attached to the side. Typically, the rack gear configuration 54 will be within a longitudinal groove to make the surface of the rack gear configuration 54 flush with the surface of the cassette 20.

A plurality of pull down cavities 56, one for each cartridge 32, is also contained on the cassette 20 for use in positioning the cassette 20 as a bullet is fired. The pull down cavity 56 provides a method to grab the cassette 20, after a round is fired and to reposition the cassette 20 into alignment for the next round. In one embodiment, FIGS. 5, 6 and 7, the pull down cavity 56 is a slotted groove at the edge of each bore 188 on the cassette 20 near the index cavity 50 on the front surface of the cassette 20. In another embodiment, FIG. 15, the pull down cavity 56 also consists of a rack gear configuration 58. The rack gear configuration 58 functioning as the pull down cavity 56 will have its "teeth" facing the opposite direction from the "teeth" of the index cavity 50. The index cavity 50 is used as a stop, whereas, the pull down cavity 56 is used for grabbing. In other embodiments, the pull down cavity could consists of bores, grooves, gears or "teeth" located on the cassette 20.

A piston port 60 located within the front plate 24 is a simple bore into the main body 12. The top opening, or bottom opening if located on the bottom, may be threaded to receive a cap 62. A piston 64 inserted into the piston port 60 operates to advance the cassette 20 through the chute 18. The set screw 62 at the top holds the piston 64 within the piston port 60 and provides pre-load force while retaining spring 70 in the main body 12.

The piston 64 is operated by gas bleed from the firing of a cartridge. Gas from the firing is directed from the breech of the barrel 14 into the piston port 60 by a gas bleed port 66. The gas bleed port 66 is drilled through the front plate 24 and through to the breech of barrel 14. A gas bleed cover plate 68 may be used as a conduit for the gases. The gases from firing a cartridge creates the necessary force to push the piston 64 within its travel path. A spring 70 is compressed by the force of the gases and the piston's movement and returns the piston 64 to its at rest position once the pressure in the piston port 60 dissipates.

A slide 72 is contained within an opening on the main body 12 and is attached to the piston 64, typically by a connecting rod 74. In another embodiment, the piston 64 and connecting rod 74 are one piece and are attached to the slide 72 with set screws or a threaded interface. The piston's function is to operate the slide 72. The slide 72 is a simple mechanism designed to operate the pulldown link 76. The pull down link 76 in turn operates to grab and reposition the cassette 20 through the chute 18. The slide 72 can be operated manually to move the cassette through the chute 18 and to manually eject the cassette 20 without firing the electrically discharges and gas operated firearm 10.

The pull down link 76 is a narrow arm attached to the slide 72. In one embodiment, FIGS. 4 and 7, one end of the pull down link 76 has a pivot attachment means, typically a bore 78 that fits over a pivot pin 80 on the slide 72. A pawl 82 is contained on the other end. Referring to FIGS. 7A–7G, as the pulldown link 76 is operated by the slide 72, the pull down link 76 pivots away from and towards the cassette 20. As the pull down link 76 pivots towards the cassette 20 the pawl 82 engages the pull down cavity 56 on the cassette 20. The pull down link 76 then operates to pull the cassette 20 to the next position by the slide 72 being operated by spring 70.

Figure 13:
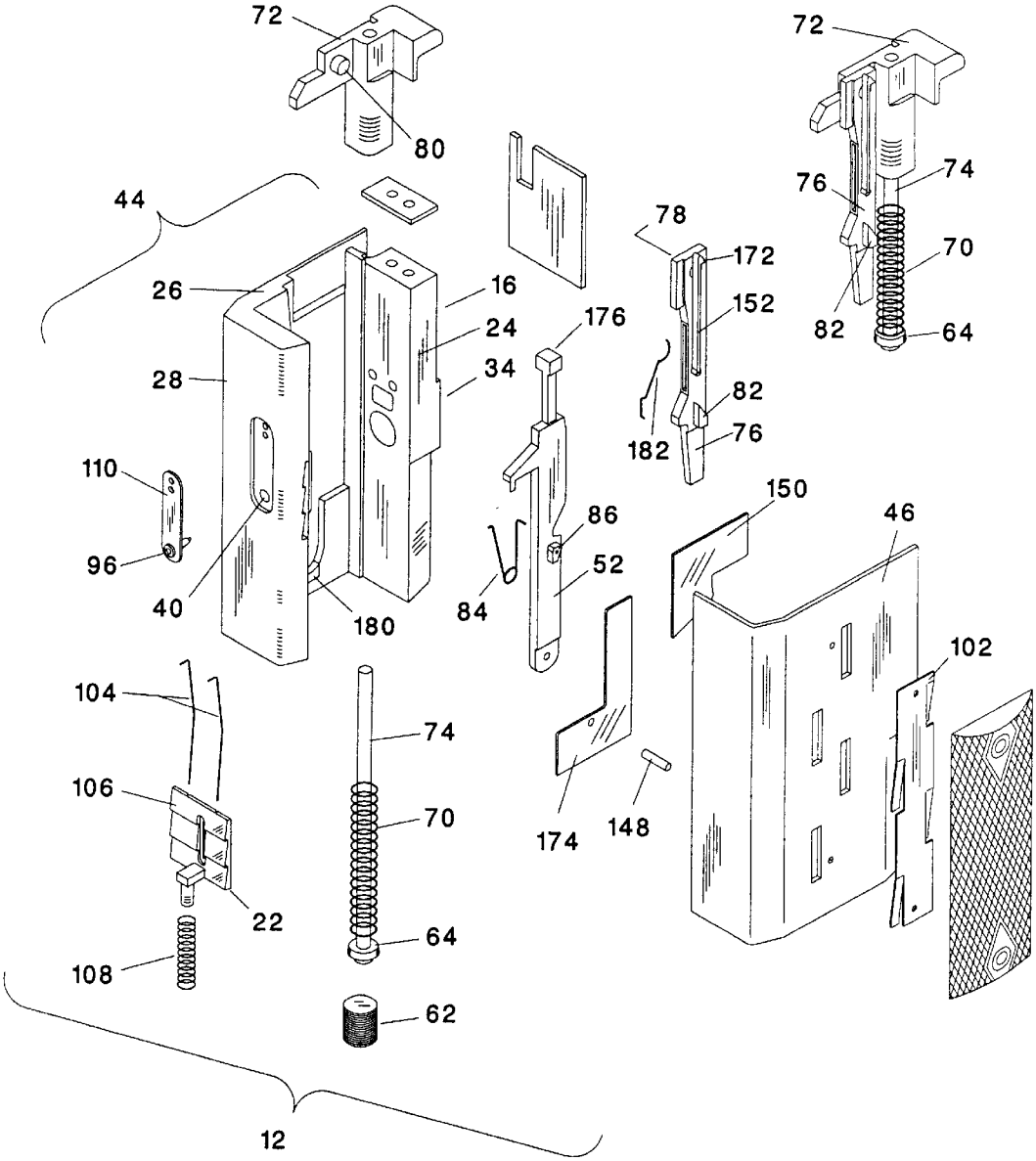
FIG. 13 is an isometric view of the main body and its components of the electrically discharged and gas operated firearm shown in FIG. 9.

In another embodiment, FIG. 13, an additional pawl 172 is attached to spring 44 which in turn is attached to the pull down link 76. This additional pawl 172 engages pull down cavities 56 of a second cassette 20 inserted in chute 18 on top of the first (partially fired) cassette 20. This implements a "preload feature" of the electrically discharged and gas operated firearm 10 of this invention and allows rapid reload without stopping the firing sequence.

The indexer link 52 is a short arm pivotally attached within an indentation in the chute 18. The indexer link 52 has an index link pin 86, which is simply a protrusion or dog, for engaging the index cavity 50 on cassette 20. The indexer link 52 is used to hold the cassette 20 in a given position during firing. Referring to FIGS. 7A–7G, as the firearm 10 is fired, the piston 64 operates to rise the slide 72 and the pull down link 76 to the next higher pull down cavity 56. As the pull down link 76 is being positioned for grabbing the next pull down cavity 56, the pull down link 76, at the top of its travel, pivots towards cassette 20. A bias to the pull down link 76 is provide by control spring 84. A cam on the pull down link 76 engages the indexer link 52 causing it to pivot and release index link pin 86 from the index cavity 50 on cassette 20. As the cassette 20 is pulled down by the pull down link 76, via the return of the piston 64 and slide 72 by spring 70, the indexer link 52 is biased towards the cassette 20 by spring 84. When the cassette 20 is properly positioned, the index link pin 86 engages the index cavity 50 to grab the cassette 20 and hold the cassette 20 in the proper position.

Vertical position of the indexer link 52 is maintained by a thrust bearing 146 and a locking set screw 144. The set screw 144 is screwed into a threaded bore located at the lower end of the indexer link 52, below the thrust bearing 146, in the main body 12. This bearing 146 is secured in the main body 12 with the set screw 144. This mechanism insures the alignment of a cartridge 32 in the cassette 20 with the barrel 14 centerline. A non-load bearing pivot pin 148 is provided to stabilize the lower end of the indexer link 52. In another embodiment, a hard surfaced bearing insert 180 is employed to maintain vertical position of cassette 20.

A retaining plate 150 secures the indexer link 52 and the pulldown link 76 in a cavity within the chute 18 in the main body 12. In another embodiment, a retaining plate 174 retains the lower end of pull down link 76 and lower end of indexer link 52.

An alternate configuration is possible where the cassette 20 would be loaded from bottom to top. The design could also be such that the gun could be used either right side up or upside down.

In operation, no cartridges 32 are transferred to or extracted from a firing chamber since they are discharged within the cassette 20. The cassette 20 is the firing chamber. No expended cartridges 32 are expelled from the electrically discharged and gas operated firearm 10 after being discharged. The cartridges 32 are retained in the cassette 20 that is being expelled.

Figure 22:
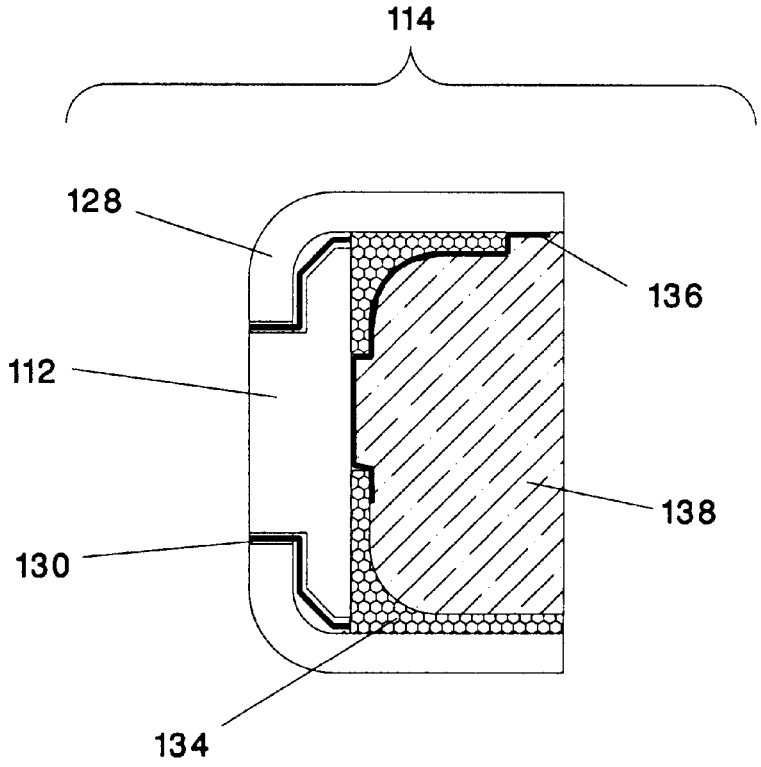
FIG. 22 is a sectional view showing the components of the electrically discharged primer of this invention.

The firing mechanism, in the preferred embodiments as illustrated and described, consists of an electronic trigger 90, electronic circuitry 92, battery 94 and an electronic firing pin 96. The trigger 90 makes electrical contact to close a circuit. The circuitry 92 contains chips, diodes, resisters and capacitors as needed to create the necessary pulse to the firing pin 96. FIG. 22 represents an electrical circuit used in the testing of the electrically discharged and gas operated firearm of this invention. However, other circuitry would work as well. The circuitry 92 controls the firing pulse duration and delay between each shot. The circuitry 92 can be set for semi-automatic or full automatic mode. Additional circuitry could be added that would provide a burst mode. Security systems could also be incorporated. The circuitry components may be contained within a housing on the barrel 14, incorporated behind handle grips, within cavities in the main body 12 or within combinations of these locations. Additionally, a series of momentary contact switches 190 can be conveniently located for programming and inserting specific codes. A liquid crystal display 164 can also be added as desired.

The electrically discharged and gas operated firearm 10 can operate in any or all of the following modes of operation by implementing the necessary circuity and programming to generate the correct electrical pulse sequence.

(a) Semi-automatic (b) Full automatic (c) Burst mode (2 or more shots in quick succession as desired)

(d) In full automatic and burst mode, the time between shots may be selected. (Increased fire rate possible with lighter cassette 20.)

Figure 17:
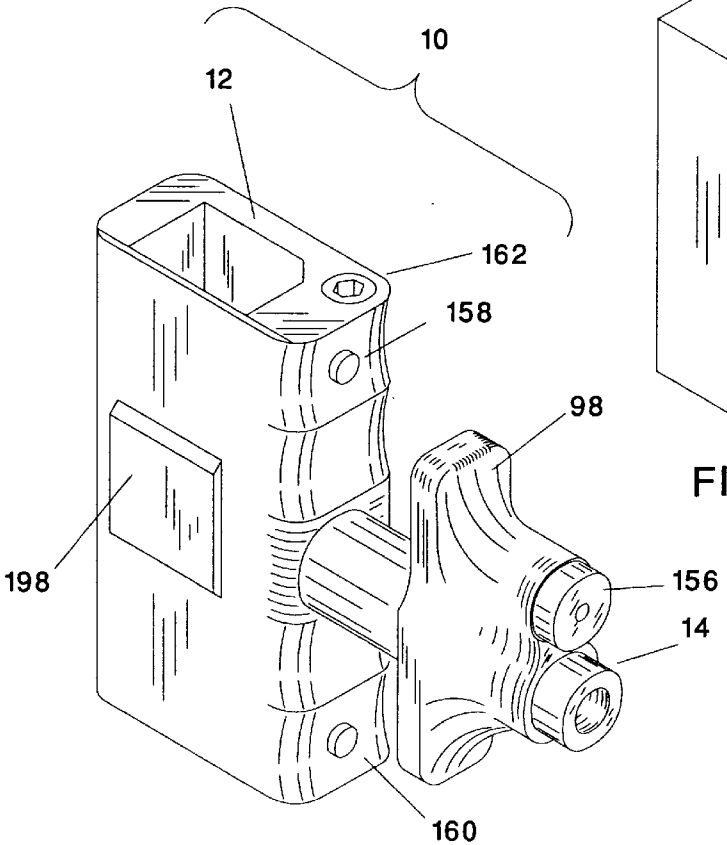
FIG. 17 shows an isometric view of yet another embodiment of the electrically discharged and gas operated firearm of this invention. This drawing shows an embodiment without graphics of the mechanics. The mechanics will be implemented in the same manner as those shown in FIGS. 9, 10, 11, 12 and 14.

The trigger 90 is generally mounted above the barrel 14 as illustrated in FIGS. 1A, 1, 9 and 10. The trigger 90 can be of many designs. As illustrated, the trigger 90 is mounted in a trigger guard 154 attached to the front surface 16 of front plate 24. The trigger 90 as illustrated is a two position switch. The first position operates to activate laser sights 156 also mounted on trigger guard 154. On another embodiment, the trigger guard 154, electronics 98 and laser sight 156 may also be mounted to the top of the barrel 14. Other embodiments may have single or multiple switches in place of a trigger. As shown in FIG. 17, the electrically discharged and gas operated firearm 10 is configured with multiple switches 158, 160 and 162 in series. All of the switches would have to be closed at the same time for firing. Closing any two of the switches would activate the laser sight 156. This configuration is designed for safety and to prevent accidental discharge of the firearm.

Figure 24:
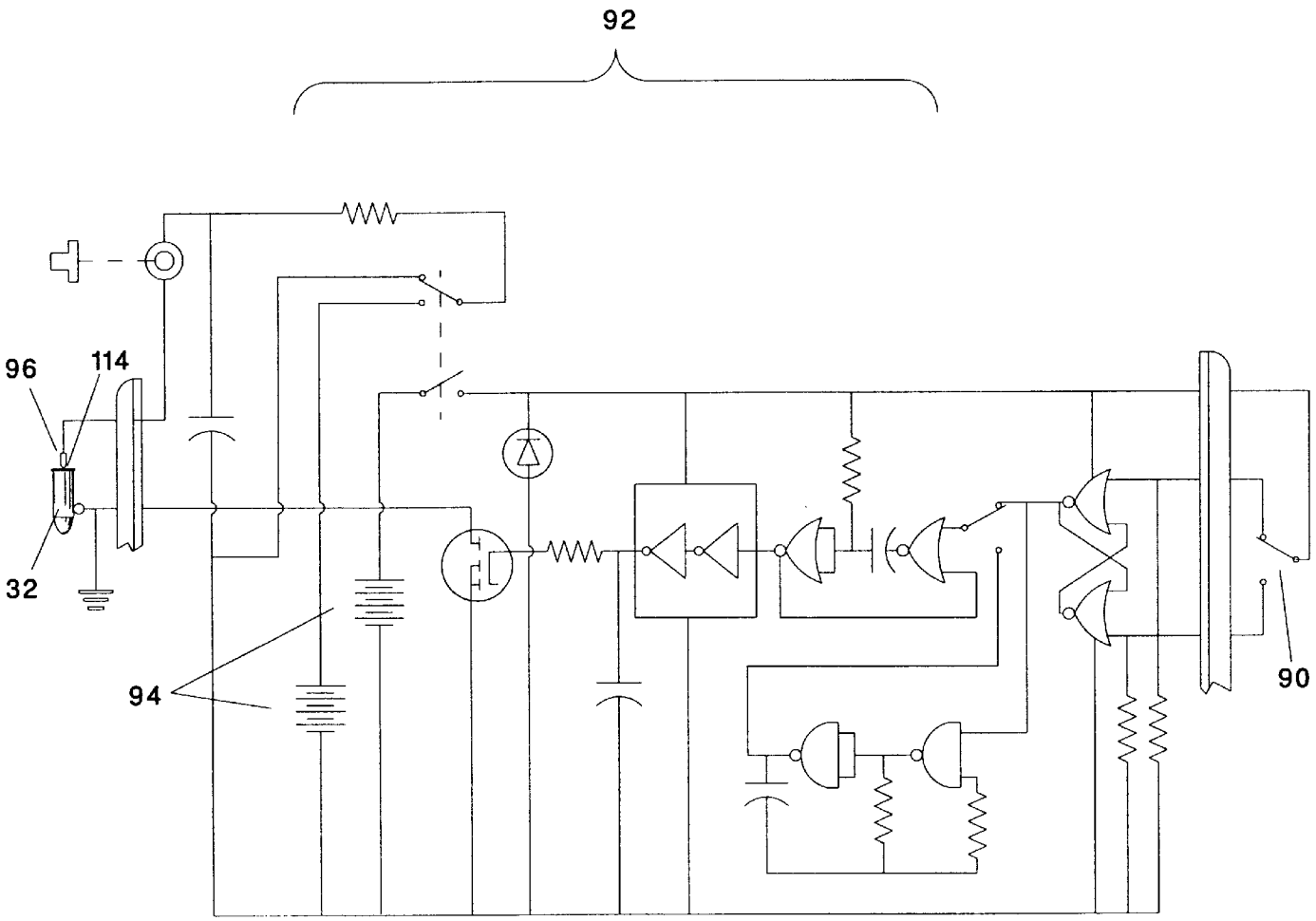
FIG. 24 is a schematical representation of a typical electric circuit used to create an electrical pulse for igniting electrically discharged primers.

Discharge of cartridges 32 is done electrically with a pulse generated by the circuitry 92 and delivered to the electrical firing pin 96. Pulling the trigger 90 closes the circuit to initiate the pulse sequence, FIG. 24.

The firing pin 96 is biased towards the cartridges 32 by leaf spring 110. The firing pin 96 is mounted on the back plate 28 of the body 12 so that the electrical firing pin 96 extends through the back plate 28 and through the clutch 22 to engage the a contact spot 112 on the primer 114.

Figure 4:
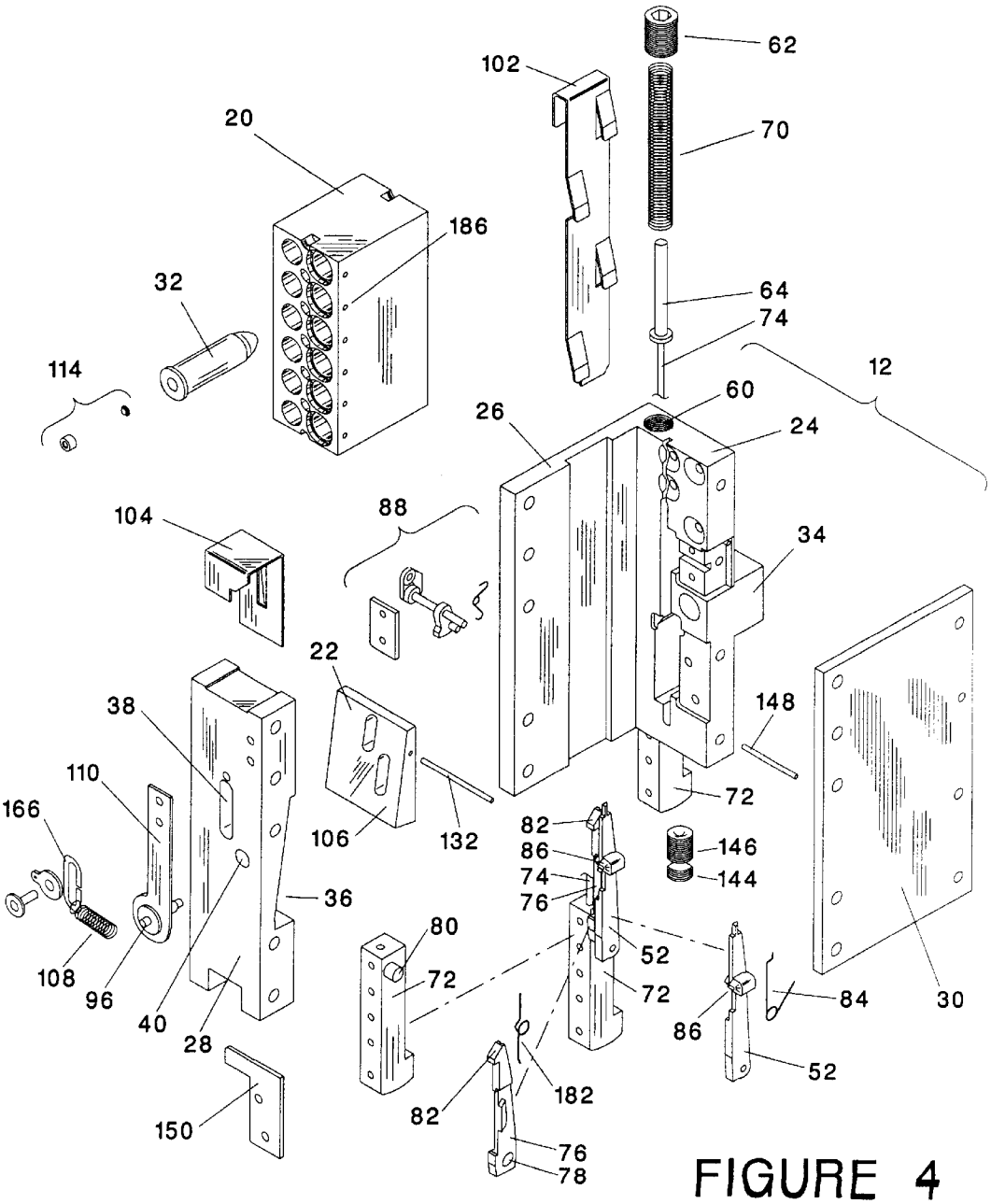
FIG. 4 is an isometric exploded view of one embodiment of the electrically discharged and gas operated firearm of this invention.
Figure 5:
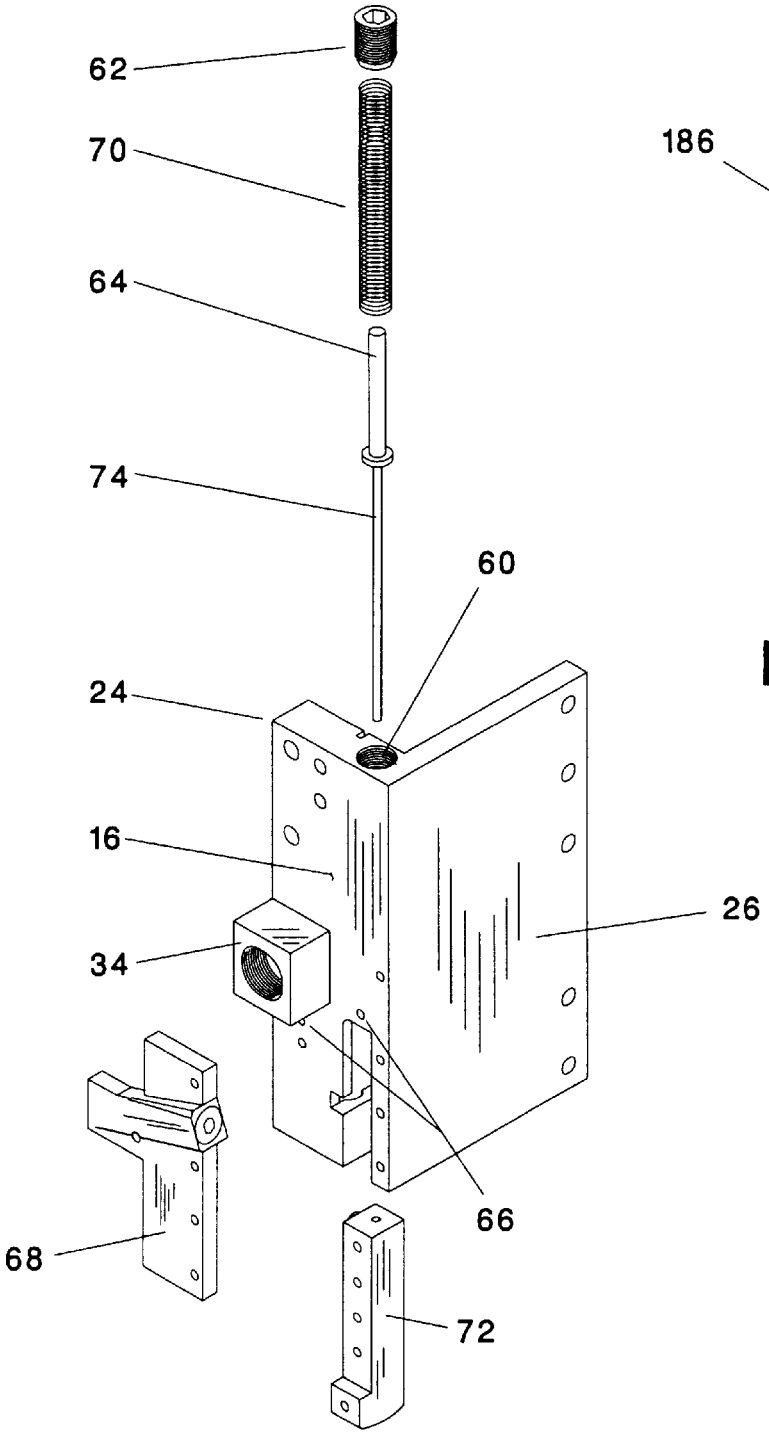
FIG. 5 is a partial exploded view of an opposite side of the main body shown in FIG. 4.

Cassette 20 stability control within the chute 18 is implemented with one way clutch 22, and lateral bias spring 102 and forward bias spring 104. Refer to FIGS. 4 and 13. The one-way clutch 22 is a wedge shaped block 106 that fits in a ramp shaped cavity area 36 on the back plate 28 behind the cassette 20. The forward face of the clutch 22 block is designed to slide against and exert a forward force on the rear face of the cassette 20. When a cassette 20 is inserted in the chute 18, it encounters the clutch block 106, which slides down its ramped shape cavity 36, causing it to retract from the cassette 20 to make room for the cassette 20 entry. The clutch block 106 is biased upward by spring 108 between the cassette 20 and the back plate 28 to exert a force that holds the cassette 20 front face against the inside surface of front plate 24 to create a no flash gap. The bias spring 108 attaches to back plate 28 via slotted plate 166 passing through hole 38 to clutch attachment pin 132 on clutch 22. Bias adjustment is provided by slotted plate 166.

The lateral bias spring 102 forces the cassette 20 against one of the side plates 26 or 30, as configured, to ensure the cassette 20 firing chambers are laterally in correct alignment with the barrel 14. The forward biasing spring 104 provides initial alignment for the cassette 20 as it enters the chute 18.

Figure 16A:
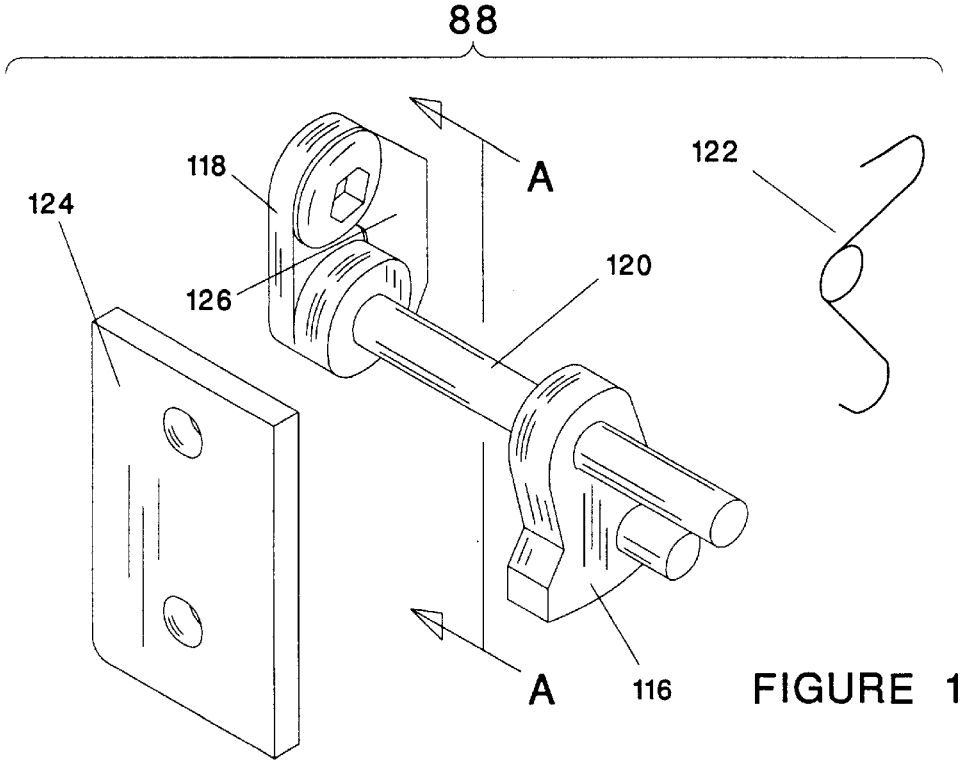
FIG. 16A is an isometric view of the delatcher shown in FIGS. 4, 8A, 8B, 8C and 8D.

The primary function of the delatcher assembly 88 is to allow the shooter to eject an expended cassette 20 from the chute 18 upon insertion of a loaded cassette 20 without any other dedicated action. The delatcher assembly 88, in one embodiment, referring to FIGS. 16A and 16B, consists of an input crank 116 and an output crank 118 joined by an axle 120, a delatcher operating spring 122 and a retaining plate 124. Mounted on the output crank 118 is a flat spring 126 with a wedge shaped dog 178. The delatcher assembly 88 is positioned within an opening within the chute 18 and is held in position by retaining plate 124.

Referring to FIGS. 8A–8D a loaded cassette 20 is inserted into the chute 18 on top of an expended cassette 20, the lower edge of the loaded cassette 20 engages the input crank 116, causing forward rotation of the axle 120 and attached output crank 118. As the output crank 118 rotates, FIGS. 8A and 8B, a flat face on the wedged shape dog 178 engages the indexer link 52 driving the index link pin 86, out of engagement from the index cavity 50 on the expended cassette 20. This allows the cassette 20 to move down freely. Further movement (manual insertion), referring to FIG. 8C, of the loaded cassette 20 further rotates the input crank 116 and output crank 118. The additional rotation (over travel) of the output crank 118 causes the flat face of wedge shaped dog 178 to disengage from the indexer link 52 allowing the index link pin 86 to reengage with newly loaded cassette 20 when an index cavity 50 again aligns with the index link pin 86, FIG. 8D.

When cassette 20 advances from the next to the last position to the last position, it breaks communication with the delatcher 88. When this happens, the delatcher 88 rotates in reverse direction as caused by delatcher spring 122 causing the inclined face (opposite to the flat face) on the wedge shaped dog 178 to engage the inclined face on the top of the indexer link 52 allowing the wedge shaped dog 178 to bypass the index link due to sideways deflection of flat spring 126. Sideways deflection of flat spring 126 occurs only during reverse direction of delatcher 88. The delatcher 88 is now reset and ready for insertion of the next full cassette, FIG. 8A.

The delatcher assembly 88 allows the shooter to hold the electrically discharged and gas operated firearm 10 in one hand, jamb a second loaded cassette 20 into chute 18 and immediately commence firing without the need to hand cycle the firearm. This allows a continuation of the firing sequence without interruption. In addition, when the first cassette 20 is empty, the shooter would jamb a second cassette 20 in on top of the first cassette 20 which would be ejected. The firearm 10 can be fired immediately and continuously without any further action.

The cassette 20 is loaded into the chute 18 from top to bottom, in the embodiments as illustrated, where it then advances through the chute 18 with each discharge and emerges from the bottom. When the last round is discharged, the cassette 20 will not be ejected. The shooter would then jamb another loaded cassette 20 in the chute 18 on top of the expended cassette 20. Again referring to FIGS. 8A–8D. This action would cause the loaded cassette 20 to activate the delatcher assembly 88 within chute 18 to disengage the indexer link 52 from the cassette 20 containing expended cartridges 32. The cassette would then be expelled from the chute 18. The first round of the loaded cassette 20 would then be automatically indexed to the barrel 14 breech. It should be noted that no manual slide operation is necessary to fire the first shot from a freshly inserted cassette 20. However, the slide 72 can be operated manually to eject the spent cassette 20 from the chute 18.

Figure 16C:
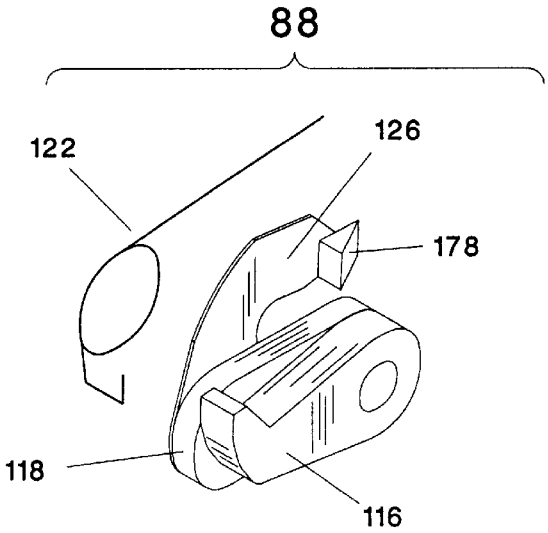
FIG. 16C is an isometric view of the delatcher shown in FIG. 14.
Figure 16B:
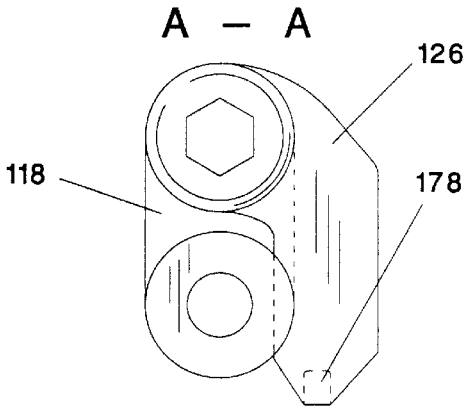
FIG. 16B is a side view of the delatcher output crank shown in FIG. 16A.

On the additional embodiment, FIGS. 14 and 16C, the delatcher 88 operation varies somewhat from the other embodiment, because of the vertical relationship of the pull down link 76, pawl 82 and the index link pin 86. FIGS. 8 and 16. On the first embodiment, the empty cassette 20 is not ejected when the last cartridge 32 is fired. On the other embodiment, the cassette 20 is ejected. In addition, on the second embodiment, the delatcher 88 would allow the shooter to sacrifice the last unfired cartridge in favor of being able to insert a full cassette 20. A manual delatch knob 176 is provided that allows the shooter to delatch the cassette 20 by momentarily pulling the manual delatch knob 176 aft. The shooter can then manually push the cassette 20 to the next position with very little effort. By holding the manual delatch knob 176 aft, the shooter can unload the firearm 10 by pushing the cassette 20 out of the chute 18 with one motion. Consequently, an additional configuration would be one without the delatcher 88 that would eject the empty cassette 20 upon firing the last cartridge.

The ammunition for the electrically operated and gas operated firearm 10 of this invention is standard with the exception of the primers 114. The electrically discharged cartridges 32 are essential for the electrically operated and gas operated firearm 10 of this invention to function. The primers 114 are either totally electrically discharged or a combination electrically or percussion discharged. The purely electrically discharged primer is illustrated in FIG. 22. The differences from a standard primer is described from the stand point of modifying an existing primer. This is for ease of understanding. It should be understood that the manufacturing of these primers will be in accordance with the end result, not as the modification is described.

The primer cup 128 has a bore though the back side, FIG. 22. The bore accepts an electrical contact 112. An insulating material 130 is used between the electrical contact 112 and the primer cup 128 to electrically insulate the two. A layer of support material 134, such as epoxy, is added to support the assembly. Conductive material 136, such as a conductive paint, is installed to bridge between the electrical contact 112 and the primer cup 128. Primer powder 138 is then added in the cavity of the primer cup over the conductive material 136. The firing pin 96 makes an electrical connection with electrical contact 112 in the primer 114. The electrical pulse received from circuitry 92 when trigger 90 is pulled, burns out the conductive material 136 causing the primer powder 138 to ignite.

Figure 23:
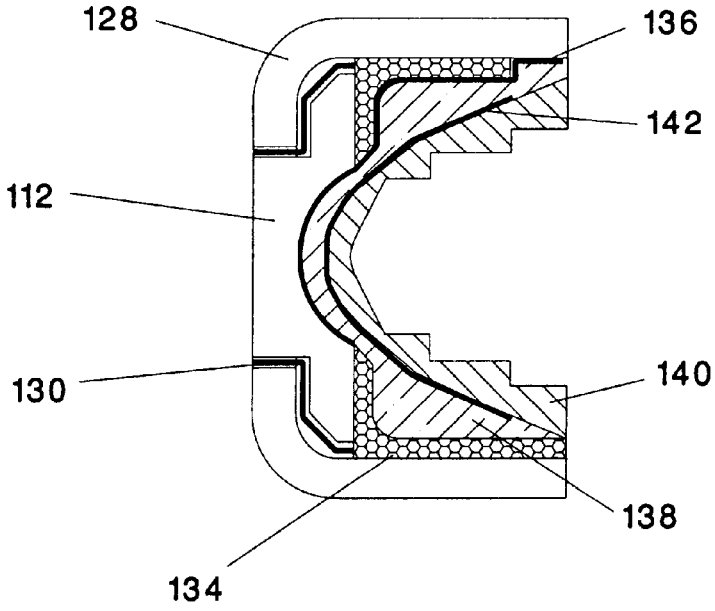
FIG. 23 is a sectional view showing the components of the primer capable of discharge with either an electrical pulse or by percussion/mechanical impact.

To make the primer 114 capable of operating in either electrical or percussion mode, FIG. 23, an anvil 140 and foil 142 would be installed over the primer powder 138. Either the anvil 140 is redesigned or the primer cup 128 is made deeper, compared to conventional primers known in the art, to make the primer 114 capable of operating either electrically or by percussion. The electrical/percussion ammunition, of this invention, is capable of operating by either electrical discharged firearms or a standard percussion fired firearm interchangeably.

Operational cycle: When a cartridge 32 is discharged, gas pressure exerts pressure on the piston 64 causing the slide 72 and pull down link 76 to reposition itself while compressing spring 70. As the pull down link 76 moves upwards to this position, surfaces on the pull down link 76 engage surfaces on the indexer link 52. This causes the pull down link 76 to pivot away from the cassette 20 as it reaches upward to the next pull down cavity 56. At the top upward travel, the surface of the pull down link 76 brakes contact with the surfaces on the indexer link 52. The pull down link control spring 182 provides the force to pivot the pull down link 76 to engage the pawl 82 of the pull down link 76 into the next pull down cavity 56 of the cassette 20.

When the gas pressure dissipates, the spring 70 within the gas port 60 releases its stored energy to drive the slide 72 and pull-down link 76 to reposition the cassette 20 at the next index position. During the downward motion cam surface on the pull down link 76 engages cam surface on the indexer link 52 which causes the index link pin 86 to pivot out of engagement with the index cavity 50 on cassette 20. Continued motion of the pull-down link 76 causes the cassette 20 to move far enough to allow re-engagement of the index link pin 86 into the next index cavity 50. Index link control spring 84 provides the force to reengage index link pin 86.

The electrically discharged and gas operated firearm 10 is now ready to fire the next round. A manual means to advance the cassette 20 through the body chute 18 in the event of a misfire is provided by manually operating the slide 72. The embodiment of FIG. 13 shows a manually operating slide 72 to advance the cassette from one cartridge to the next. However, the indexer link 52 has a manual delatch knob 176 that extends above the main body 12 of the firearm 10 and is accessible to the shooter. To manually advance the cassette 20 to the next position, the shooter would momentarily move the manual delatch knob 176 to the rear of the firearm and then manually push the cassette to the next position. To unload the firearm, the shooter would pull back and hold the manual delatch knob 176 while pushing the cassette on through and out of the chute 18.

The electrically discharged and gas operated firearm does not have the additional recoil effects of an operating slide or bolt that is present in the conventional 1911 style semi-automatic. This is because there is no horizontal operating slide as used in that firearm. The electrically discharged and gas operated firearm described herein is configured to reduce recoil that is exhibited by all present day firearms, This thereby, enhancing accuracy and shooting comfort.

Figure 21B:
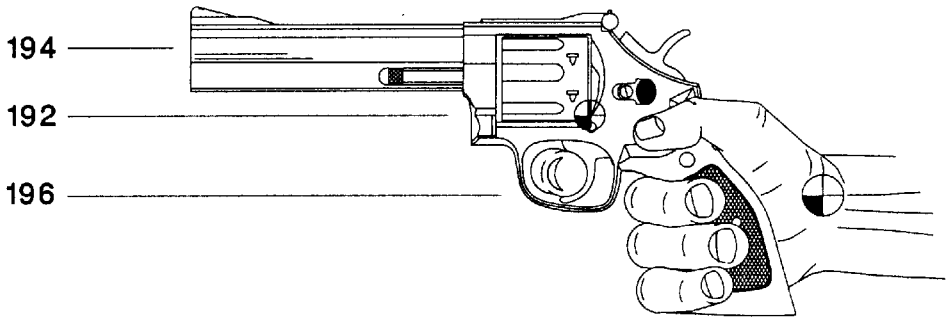
Figure 21C:
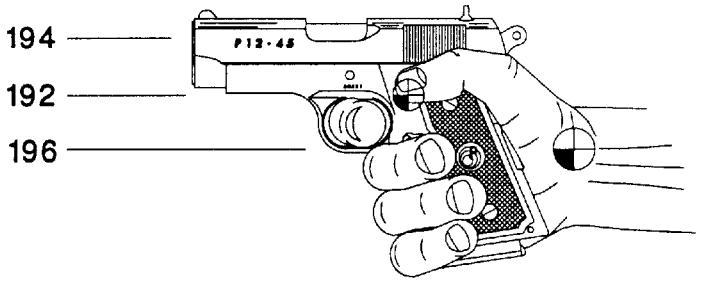

With this invention there is no rearward moving bolt to cause the "kick" associated with the horizontally moving slide or bolt. It has been demonstrated by actual firing that there is no kick or upward rotation during actual firing. The majority of mass of the electrically discharged and gas operated firearm 10 and the cassette 20 (containing firing chambers and ammunition), excluding the barrel 14, is held within the hand of the shooter near the wrist pivot. FIGS. 21A–21C shows the relationship of a typical revolver and a semi-automatic to the electrically discharged and gas operated firearm described herein. The center of gravity, and moment are shown be circles with partially shaded partitions. It should also be recognized that for a given barrel 14 length the design herein disclosed could have a shorter overall length when compared to conventional firearms with the same size barrel. With the elimination of flip, a target may be acquired and fired upon multiple times without having to realign on the target before each successive shot. As illustrated, the center of gravity has been moved from the top of the hand as with a revolver and semi-automatic, to a position in front of the hand. The rearward force of discharge is now in line with the axis of the arm to eliminate flip and rotation of the arm.

Figure 19:
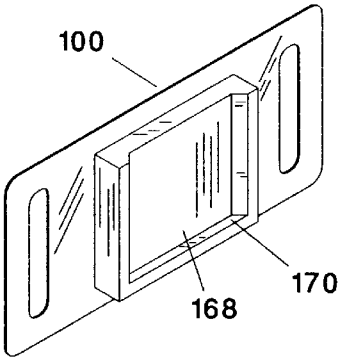
FIG. 19 illustrates a magnetic holster that can be used with the electrically discharged and gas operated firearm of this invention.

A magnetic holster 100, shown in FIG. 19, may be used with the electrically discharged and gas operated firearm 10 of this invention. A magnet 168 within a receiver 170 on holster 100 would contact a tab 198 mounted on a side of the main body 12.

Figure 1:
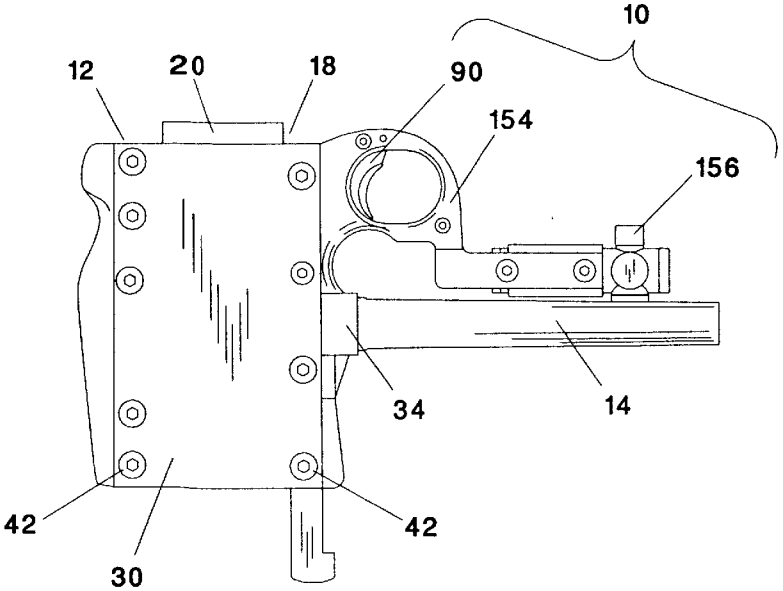
FIG. 1 is a side view of one embodiment of the electrically discharged and gas operated firearm of this invention.
Figure 1A:
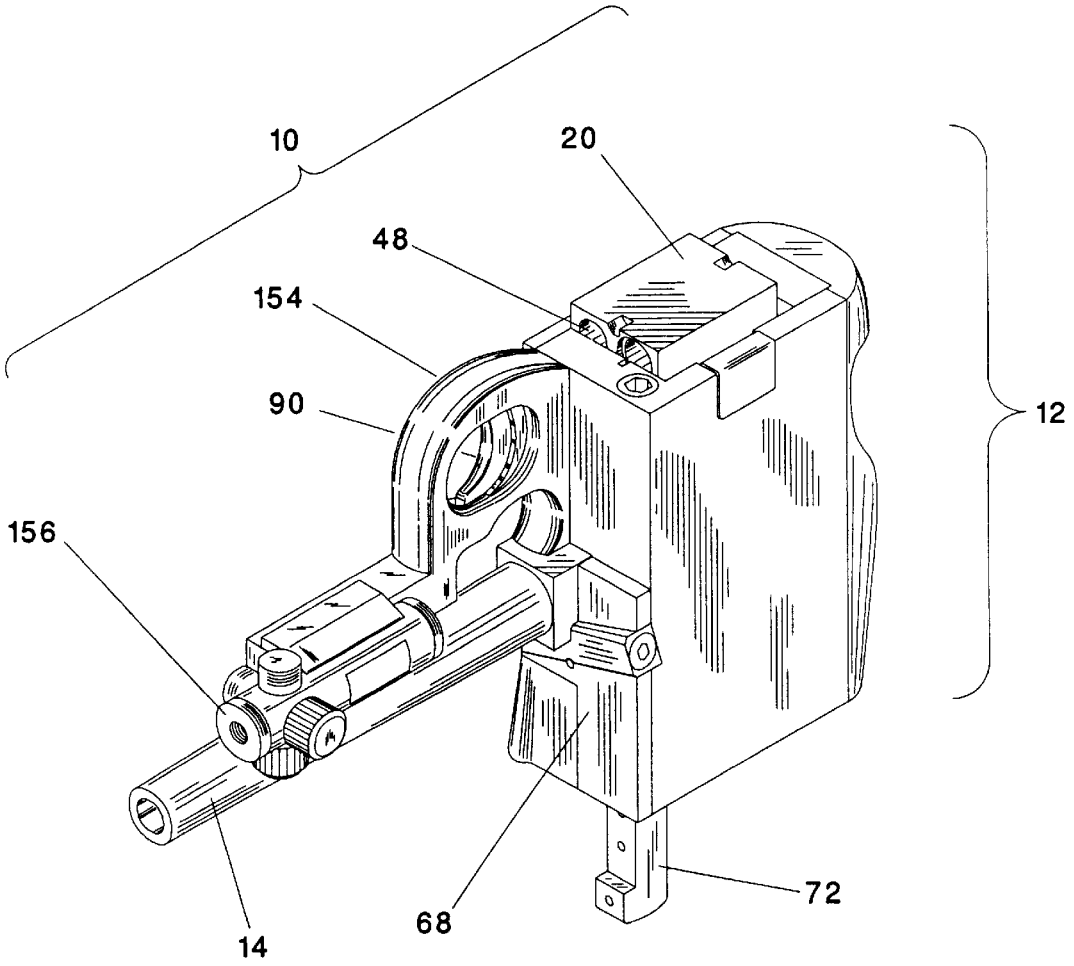
FIG. 1A is an isometric view of one embodiment of the electrically discharged and gas operated firearm of this invention.
Figure 12:
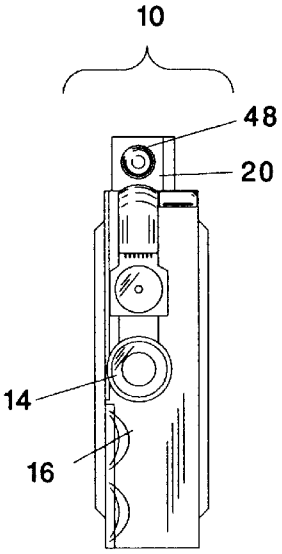
FIG. 12 is a front view of FIG. 9.
Figure 10:
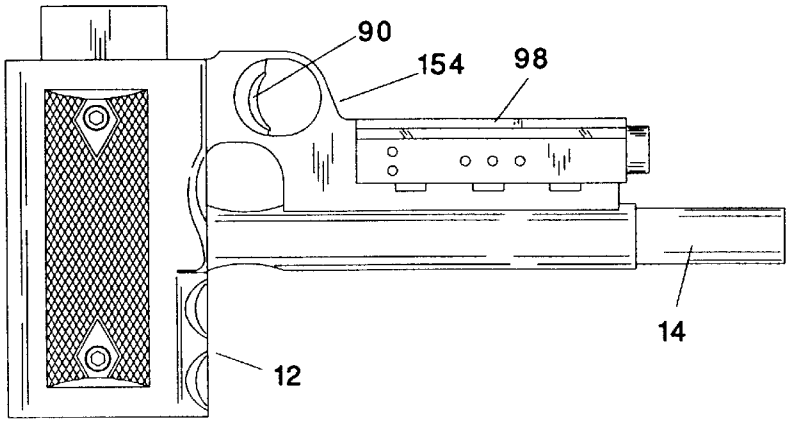
FIG. 10 is a side view of the embodiment shown in FIG. 9.
Figure 15:
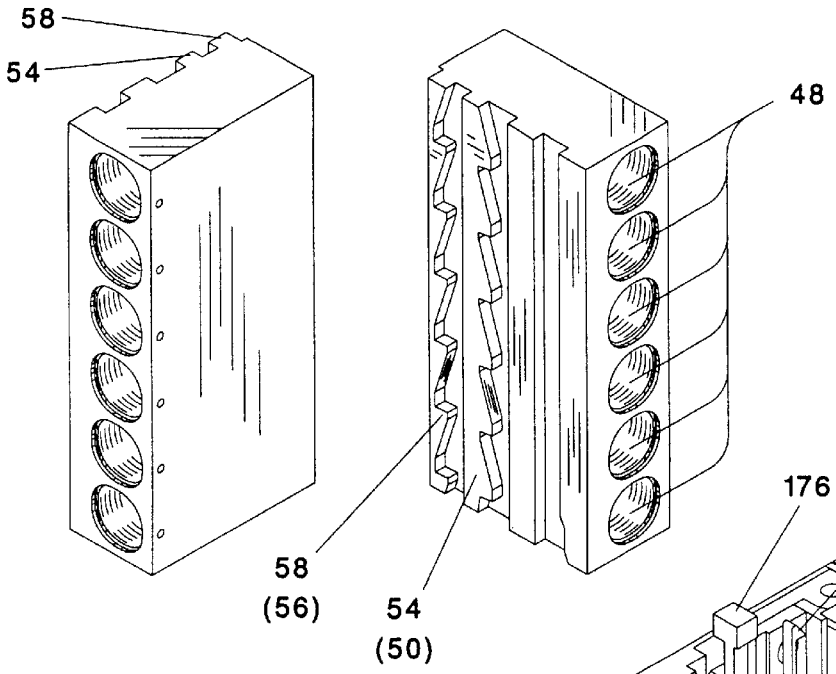
FIG. 15 is a flip drawing showing both sides of the cassette used in the electrically discharged and gas operated firearm shown in FIG. 9.
Figure 18:
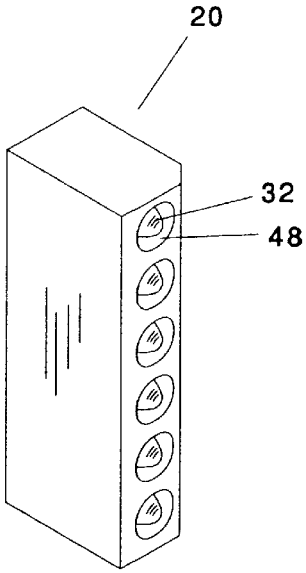
FIG. 18 is an isometric view of the cassette used with the embodiment shown in FIG. 17. This drawing shows an embodiment of the cassette without the operating mechanism. The operating mechanism will be the same as those shown in FIG. 15.

Cassette 20 may be either reusable, or expendable and single or multiple rows. A multiple row configuration is shown in FIGS. 1A, 4 and 6. Single row configurations are shown in FIGS. 12, 15, and 18. A multiple barrel electrically discharged and gas operated firearm could also be constructed when used with a two row cassette 20. All cartridges 32 would face the same direction.

The operating mechanism as described herein could also be easily incorporated into a long gun. The long gun has the additional feature of more room. As such, the electrically operated firing pin, as herein described, could be replaced with a percussion type firing pin. This could be either a mechanically operated firing pin or an electrically driven firing pin. The configuration, arrangement and operation of the various components as described would of course have to be modified, but the basic operating principle remains the same and within the scope of these inventive concepts.

Having described the invention in detail, those skilled in the art will appreciate that modifications may be made of the invention without departing from the spirit of the inventive concept herein described.

Therefore, it is not intended that the scope of the invention be limited to the specific and preferred embodiments illustrated and described. Rather, it is intended that the scope of the invention be determined by the appended claims and their equivalents.

What is claimed is:

1. An electrically discharged and gas operated firearm comprising:

a main body having a barrel extending therefrom and a chute through said main body;

a cassette for receiving a plurality of cartridges, said cassette fitting within and slidable through said chute in said main body;

a gas operation means for pulling and sequencing said cassette through said chute and aligning said cartridges one at a time with said barrel; and an electrical firing means for discharging said cartridges.

2. The electrically discharged and gas operated firearm as set forth in claim 1 in which said main body comprises a front plate, back plate, left side plate and right side plates, said plates defining said chute through the center of said main body.

3. The electrically discharged and gas operated firearm as set forth in claim 2 in which said main body further comprises a barrel attachment means contained on said front plate, said barrel being attached to said barrel attachment means.

4. The electrically discharged and gas operated firearm as set forth in claim 1 in which said gas operation means comprises:

a piston contained within said main body, said piston being operated upon by discharge gases from a discharging cartridge;

a pull down link operated by said piston, said pull down link engaging said cassette to pull said cassette through said chute; and an indexer link operated upon by said pulldown link, said indexer link engages and disengages said cassette; said indexer link holding said cassette in a specific position when a cartridge contained within said cassette is in alignment with said barrel.

5. The electrically discharged and gas operated firearm as set forth in claim 1 in which said gas operation means comprises:

a piston installed within a piston port in said main body, said piston being operated by gases feed from the breech of said barrel through a gas port extending from said breech to said piston port;

a slide connected to and operated by said piston, said slide contained within an opening on said body and traveling in conjunction with said piston;

a pulldown link pivotally attached to said slide and positioned within an indentation on an inside surface of said chute, said pulldown link having a pawl to engage said cassette; as said slide operates said pulldown link said pulldown link operates to reposition said cassette in said chute; and an indexer link pivotally attached within an indentation within said chute, said indexer link pivotally operated by said pulldown link, said indexer link having an index link pin that engages or disengages an index cavity on said cassette as said indexer link is pivoted; said indexer link holding said cassette in a specific position when said index link pin is engaged with said index cavity in such a position that a bore within said cassette containing a cartridge on said cassette is in alignment with said barrel.

6. The electrically discharged and gas operated firearm as set forth in claim 1 in which said electrical firing means comprises:

an electric trigger attached to an outside surface of said main body;

an electrical firing pin attached to and extending through an opening on a back side of said main body, said electrical firing pin in alignment with a cartridge contained within said cassette; and an electric circuit electrically attached between said electric firing pin and said electric trigger for providing a controlled electrical pulse to said electric firing pin when said electric trigger is actuated.

7. The electrically discharged and gas operated firearm as set forth in claim 5 further claiming a delatcher assembly contained within an opening in said chute in said main body, said delatcher assembly disengages said index link pin from said index cavity on said cassette as a second cassette is inserted into said chute allowing a first cassette in said chute to be ejected from said chute.

8. The electrically discharged and gas operated firearm as set forth in claim 7 in which said delatcher assembly comprises an input crank and an output crank connected together by an axle and biased with a delatcher operating spring; said delatcher assembly being retained within an opening within said chute by a retainer plate; said input crank being a clog that engages a second cassette as said second cassette is inserted into said chute; said axle being rotated by said input crank which in turn operates said output crank, said output crank being a second clog that engages and pivots said indexer link to disengage said indexer link pin so the first cassette can be expelled from said chute.

9. The electrically discharged and gas operated firearm as set forth in claim 1 further claiming a one way clutch block, said clutch block being a wedge shaped block that fits in a cavity area on an inside back surface of said chute, said clutch block slides against and exerts a forward force on a rear face of said cassette, said clutch block restricts cassette movement to one direction by squeezing said clutch block against said cassette if moved in an opposite direction.

10. The electrically discharged and gas operated firearm as set forth in claim 1 further claiming a lateral cassette bias spring and a forward cassette bias spring; said lateral cassette bias spring mounted along one side of said chute for exerting lateral bias to said cassette in said chute, and said forward cassette bias spring mounted along a back surface of said chute for exerting forward bias to said cassette.

11. The electrically discharged and gas operated firearm as set forth in claim 5 further claiming a thrust bearing located under said indexer link in said main body, said indexer link resting upon a top surface of said thrust bearing, said thrust bearing used for vertical positioning of said index link and firing position of said cassette, said thrust bearing being secured and position adjustable within said main body.

12. The electrically discharged and gas operated firearm as set forth in claim 1 further claiming a laser sight, said laser sight being attached to either said main body or said barrel and being in alignment with said barrel.

13. The electrically discharged and gas operated firearm as set forth in claim 6 in which said electric circuit further comprises security measures programmable into said electric circuit to prevent unauthorized firing of said electrically discharged and gas operated firearm.

14. The electrically discharged and gas operated firearm as set forth in claim 6 in which said electric circuit further comprises programmability for firing sequence of said electrically discharged and gas operated firearm, in which said firing sequence controls a number of shots fired for each trigger pull, the timing between shots, and selectable between full automatic operation, semi-automatic operation or burst firing.

15. The electrically discharged and gas operated firearm as set forth in claim 6 in which said electric trigger comprises a plurality of electric switches wired in series such that all of said switches have to be closed for the electrically discharged and gas operated firearm to fire.

16. The electrically discharged and gas operated firearm as set forth in claim 1 further claiming a cartridge remaining indication, said cartridge remaining indication comprising spots within said chute to indicate the number of remaining unfired cartridges in said cassette.

17. The electrically discharged and gas operated firearm as set forth in claim 16 in which said cartridge remaining indication comprises two small spots and one single large spot properly position that said two spots indicate two remaining unfired cartridges and said single large spot indicated a single unfired cartridge remains.

18. The electrically discharged and gas operated firearm as set forth in claim 1 further claiming a cartridge retention means, said cartridge retention means providing a friction or mechanical hold on said cartridges in said cassette to prevent said cartridges from falling out of said cassette.

19. The electrically discharged and gas operated firearm as set forth in claim 18 in which said cartridge retention means comprises a plastic rod inserted into a small bore on a side of said cassette and extending into lateral bores containing said cartridges on said cassette, said plastic rod contacting and providing a friction hold on casing of said cartridges.

20. The electrically discharged and gas operated firearm as set forth in claim 6 in which said electric firing pin makes direct electrical contact with an electrically discharged cartridge contained within said cassette and transmits said electric pulse to said electrically discharged cartridge.

21. The electrically discharged and gas operated firearm as set forth in claim 6 in which said electric firing pin comprises an electrically operated firing pin being driven into said cartridge to fire said cartridge by percussion when said electrically operated firing pin is activated by said electrical pulse from said electric circuit.

22. An electrically discharged and gas operated firearm comprising:

a main body having a barrel extending therefrom and a chute through said main body;

a cassette for receiving a plurality of cartridges, said cassette fitting within and slidable through said chute in said main body;

a piston contained within said main body, said piston being operated upon by discharge gases from a discharging cartridge;

a pull down link operated by said piston, said pull down link engaging said cassette to pull said cassette through said chute; and an indexer link operated upon by said pulldown link, said indexer link engages and disengages said cassette; said indexer link holding said cassette in a specific position when a cartridge contained within said cassette is in alignment with said barrel; and an electrical firing means for discharging said cartridges.

23. An electrically discharged and gas operated firearm comprising:

a main body having a barrel extending therefrom and a chute through said main body;

a cassette for receiving a plurality of cartridges, said cassette fitting within and slidable through said chute in said main body;

a gas operation means for sequencing said cassette through said chute and aligning said cartridges one at a time with said barrel; and an electric trigger attached to an outside surface of said main body;

an electrical firing pin attached to and extending through an opening on a back side of said main body, said electrical firing pin in alignment with a cartridge contained within said cassette; and an electric circuit electrically attached between said electric firing pin and said electric trigger for providing a controlled electrical pulse to said electric firing pin when said electric trigger is actuated.

* * * * *

UNITED STATES PATENT AND TRADEMARK OFFICE
Certificate

Patent No. 5,937,558 Patented: August 17, 1999

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Donald G. Gerard, St. Charles, MO; and Jeffrey C. Green, Edwardsville, IL.

Signed and Sealed this Sixth Day of April 2004.

MICHAEL J. CARONE
*Supervisory Patent Examiner*
Art Unit 3641